United States Patent [19]

Renner

[11] Patent Number: 4,942,116

[45] Date of Patent: Jul. 17, 1990

[54] COLOR PHOTOGRAPHIC RECORDING MATERIAL CONTAINING 2-EQUIVALENT MAGENTA COUPLERS

[75] Inventor: Günter Renner, Bergisch Gladbach, Fed. Rep. of Germany

[73] Assignee: Agfa-Gevaert Aktiengesellschaft, Leverkusen, Fed. Rep. of Germany

[21] Appl. No.: 74,689

[22] Filed: Jul. 17, 1987

[30] Foreign Application Priority Data

Jul. 29, 1986 [DE] Fed. Rep. of Germany ..... 3625816

[51] Int. Cl.[5] ..... G03C 7/384

[52] U.S. Cl. ..... 430/555; 430/551

[58] Field of Search ..... 430/551, 544, 555

[56] References Cited

U.S. PATENT DOCUMENTS

| | | | |
|---|---|---|---|
| 4,413,054 | 11/1983 | Mitsui et al. | 430/555 |
| 4,489,155 | 12/1984 | Sakanoue et al. | 430/551 |
| 4,536,472 | 8/1985 | Kato et al. | 430/555 |
| 4,555,479 | 11/1985 | Sakai et al. | 430/551 |
| 4,556,630 | 12/1985 | Furutachi et al. | 430/555 |
| 4,565,777 | 1/1986 | Ogawa et al. | 430/555 |
| 4,567,135 | 1/1986 | Arakawa et al. | 430/555 |
| 4,585,728 | 4/1986 | Furutachi et al. | 430/551 |
| 4,729,944 | 3/1988 | Mihayashi et al. | 430/555 |
| 4,745,052 | 5/1988 | Renner | 430/555 |
| 4,789,624 | 12/1988 | Sakanoue et al. | 430/551 |
| 4,804,617 | 2/1989 | Nishikawa et al. | 430/555 |

FOREIGN PATENT DOCUMENTS

| | | | |
|---|---|---|---|
| 0002953 | 1/1985 | Japan | 430/555 |
| 1122646 | 6/1986 | Japan | 430/555 |

*Primary Examiner*—Paul R. Michl
*Assistant Examiner*—Lee C. Wright

[57] ABSTRACT

Improved 2-equivalent magneta couplers correspond to the following formula in which B is a stabilizing group, X is a phenylmercapto group substituted in a certain way, Y is halogen, alkoxy, alkyl, alkylsulfonyl, acylamino, alkoxycarbonyl, aminocarbonyl, amino, trifluoromethyl or cyano, n, o=0, 1 or 2 p=≦3−o and q=≦5−n with the proviso that, where n, o, p and/or q have a value of >1, the substitutents B and Y may be the same or different.

4 Claims, No Drawings

COLOR PHOTOGRAPHIC RECORDING MATERIAL CONTAINING 2-EQUIVALENT MAGENTA COUPLERS

This invention relates to a color photographic recording material comprising at least one silver halide emulsion layer and at least one layer containing a 2-equivalent magenta coupler having a certain constitution.

It is known that pyrazolone compounds in which the 4-position of the pyrazolone ring is free (4-equivalent magenta couplers) can be used as magenta couplers in color photographic photosensitive recording materials. However, these compounds are only of limited effectiveness for dye production. In addition, the stability of these compounds, particularly in storage under tropical conditions, is unsatisfactory.

Accordingly, the effectiveness of dye production was improved by using so-called 2-equivalent magenta couplers in which a substituent is introduced into the coupling position of the pyrazolone magenta coupler and eliminated as a leaving group during the color development reaction. Couplers of this type are described, for example, in US-PS Nos. 3 311 476, 3 419 391, 3 617 291 and 3 926 631. Other magenta couplers in which a substituent is attached to the coupling position by a sulfur atom are described in U.S. Pat. Nos. 3,214,437, 4,032,346, 3,227,554 and 3,701,783 and in JA No. 34044/78 and in DE-OS No. 29 44 601.

Extensive studies have shown that, where couplers containing an arylthio group as leaving group are used, the light stability of the dye images is not entirely satisfactory.

In addition, it has been found that many of the thiophenols released during the coupling of 2-equivalent couplers of the type in question are not photographically acceptable. Not only can they impede further development, they can also inhibit bleach fixing after development, as reflected in a residual $Ag^o$-image.

The object of the present invention is to provide 2-equivalent magenta couplers which 1. may be used for color reflection materials, i.e.
   (a) show favorable absorption properties,
   (b) are characterized by very effective dye production,
   (c) show high stability both in dry and in moist heat,
   (d) show high formaldehyde stability after development,
   (e) do not inhibit bleaching in bleach fixing baths, particularly after prolonged use, and
   (f) produce dyes of excellent stability both in dry and in moist heat and under the effect of light,
2. contain readily accessible groups to be eliminated during the coupling reaction with oxidized color developer and
3. are not significantly affected by routine changes in the pH value of the color developer.

It has now been found that these objects can be achieved with 2-equivalent magenta couplers having the structure shown below.

Accordingly, the present invention relates to a color photographic recording material comprising at least one silver halide emulsion layer and at least one layer containing a 2-equivalent magenta coupler corresponding to the following formula

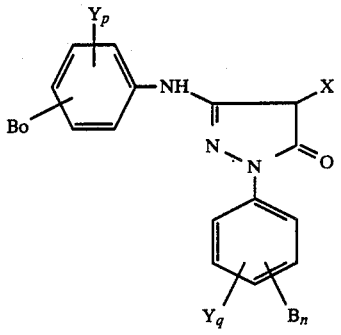

(I)

in which

B is a stabilizing group,

Y is halogen, alkoxy, alkyl, alkylsulfonyl, acylamino, alkoxycarbonyl, optionally substituted aminocarbonyl, optionally substituted amino, trifluoromethyl or cyano, X represents a group corresponding to the following formulae

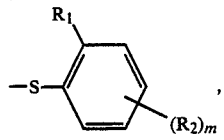

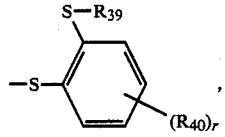

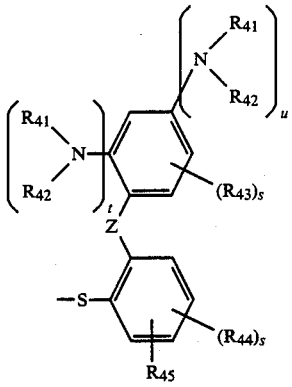

$R_1$ is alkyl containing at least 3 carbon atoms, $R_2$ is alkyl, halogen, cyano or trifluoromethyl, $R_{39}$ is alkyl, $R_{40}$ is halogen, alkoxy, alkyl, alkylamino, acylamino or alkoxycarbonyl, $R_{41}$ and $R_{42}$ are alkyl, acyl or alkylsulfonyl, $R_{43}$ is a substituent having electron acceptor properties, $R_{44}$ is a substituent having electron donor properties, $R_{45}$ is hydrogen or alkyl, Z is O, S or $NR_{46}$ and $R_{46}$ is hydrogen or $C_1$–$C_4$ alkyl, m, n, o, r, s, =0, 1 or 2, $p = \leqq 3 - o$ and $q = \leqq 5 - n$, u, t=0 or 1, the sum of u and t being 1 or 2, with the proviso that, where m, n, o, p, q, r and/or s have a value of >1, the substituents $R_2$, $R_{40}$, $R_{43}$, $R_{44}$, B and Y may be the same or different.

X preferably corresponds to a group having the following formula

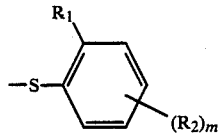

in which $R_1$, $R_2$ and m are as defined above. In particular, the sum of the carbon atoms in the alkyl radicals $R_1$ and $R_2$ is from 6 to 24.

Stabilizing groups are, in particular, groups which decelerate both yellowing and also fading, for example aromatic mono- and polyols attached through bridge members and ethers thereof, sulfamidophenols, secondary or tertiary aromatic compounds and thiophenol derivatives.

Suitable stabilizing groups B are, for example, those corresponding to the following formulae:

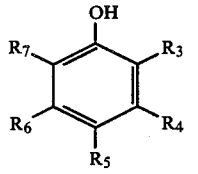

(II)

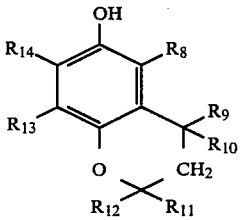

(III)

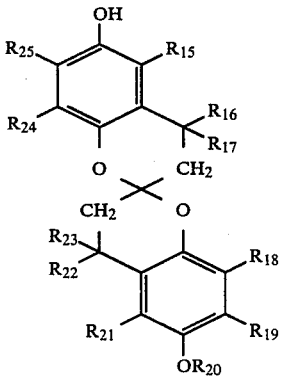

(IV)

and ethers thereof which are attached to the coupler molecule by the OH group or one of the substituents $R_3$ to $R_{25}$ via a direct bond or a bridge member.

In formulae (II) to (IV), the substituents have the following meanings: $R_3$, $R_4$, $R_5$, $R_6$, $R_7$: hydrogen, halogen, alkyl, alkoxy, aryl, aryloxy, carboxy, sulfo, alkoxycarbonyl, alkylamido, arylamido, carbamyl, alkylcarbamyl, arylcarbamyl, sulfamyl, alkylsulfamyl, arylsulfamyl, alkylsulfonyl or arylsulfonyl, $R_8$, $R_9$, $R_{10}$, $R_{11}$, $R_{12}$, $R_{13}$, $R_{14}$, $R_{15}$, $R_{16}$, $R_{17}$, $R_{18}$, $R_{19}$, $R_{20}$, $R_{21}$, $R_{22}$, $R_{23}$, $R_{24}$, $R_{25}$: hydrogen or alkyl.

Halogen is in particular fluorine, chlorine or bromine. Alkyl is in particular $C_1$–$C_{18}$ alkyl. Alkoxy is in particular $C_1$–$C_{12}$ alkoxy. Acylamino is in particular $C_1$–$C_{18}$ alkylcarbonylamino, $C_1$–$C_{18}$ alkylsulfonylamino and $C_1$–$C_{18}$ alkoxycarbonylamino and also benzoylamino and benzenesulfonylamino. Alkoxycarbonyl is, in particular, $C_1$–$C_{18}$ alkoxycarbonyl. Optionally substituted amino or aminocarbonyl is in particular mono- or di-$C_1$–$C_8$-alkylamino or -alkylaminocarbonyl.

Aryl is in particular phenyl, aryloxy, more especially phenoxy, arylamido, more especially benzoylamino, arylcarbamyl, more especially phenylcarbamyl, arylsulfamyl, more especially phenylsulfamyl, and arylsulfonyl, more especially phenylsulfonyl.

The alkyl groups of alkylcarbamyl, alkylsulfamyl and alkylsulfonyl contain in particular from 1 to 12 carbon atoms. Bridge members are, in particular, $C_1$–$C_{18}$ alkylene carbonylamino. Ether derivatives of the phenolic OH groups are in particular the $C_1$–$C_{12}$ alkylethers.

Alkylamino is, in particular, mono- and di-$C_1$–$C_8$-alkylamino. Acyl is, in particular, $C_1$–$C_{18}$ alkylcarbonyl.

Suitable electron donors are, in particular, $C_1$–$C_6$ alkyl, halogen, hydroxy, $C_1$–$C_6$ alkoxy and di-$C_1$–$C_6$-alkylamino.

Suitable electron acceptors are, in particular, halogen, cyano, trifluoromethyl, nitro, $C_1$–$C_8$ alkylsulfonyl and di-$C_1$–$C_8$-alkylaminosulfonyl.

Preferred couplers correspond to the following formula

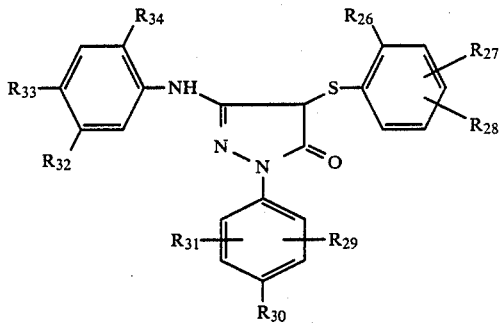

(V)

in which $R_{26}$ is $C_3$–$C_{12}$ alkyl, $R_{27}$ is $C_3$–$C_9$ alkyl, more especially secondary or tertiary $C_3$–$C_9$ alkyl, or chlorine, the total number of carbon atoms in the alkyl radicals $R_{26}$ and $R_{27}$ being from 6 to 16, $R_{28}$ is hydrogen, chlorine or cyano, $R_{29}$ is chlorine, $R_{30}$ is hydrogen, methoxy, chlorine, methyl, cyano or $B_1$, $R_{31}$ is chlorine or methyl, $R_{32}$ is hydrogen, di-$C_1$–$C_6$-alkylaminocarbonyl, $C_1$–$C_6$ alkylcarbonylamino or $B_1$, $R_{33}$ is hydrogen or chlorine and $R_{34}$ is chlorine or methoxy, either $R_{30}$ or $R_{32}$ having the meaning $B_1$ and $B_1$ is a group corresponding to the formula

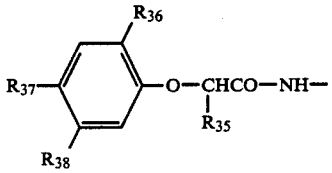

in which $R_{35}$ is hydrogen or $C_1$–$C_{12}$ alkyl, $R_{36}$ is hydrogen, $C_1$–$C_8$ alkoxy, hydroxy, $C_1$–$C_8$ alkylcarbonyloxy or $C_1$–$C_8$ alkyl, $R_{37}$ is hydrogen, hydroxy, $C_1$–$C_{12}$ alkoxy or $C_1$–$C_8$ alkyl and $R_{38}$ is hydrogen or $C_1$–$C_8$ alkyl.

The substituents in formula V preferably have the following meanings:

$R_{26}$ and $R_{27}$ are alkyl, both alkyl radicals together containing from 6 to 16 carbon atoms, $R_{28}$ and $R_{33}$ are hydrogen, $R_{29}$, $R_{30}$, $R_{31}$ and $R_{34}$ are chlorine and $R_{32}$ is a group corresponding to the following formula

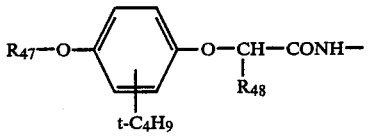

in which $R_{47}$ and $R_{48}$ are hydrogen or $C_1$–$C_{12}$ alkyl.

Suitable radicals having the partial structure A

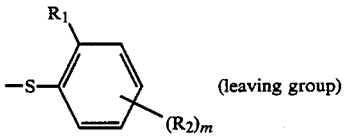

are, for example,

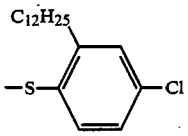

A1

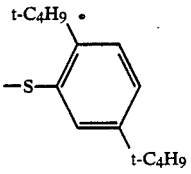

A2

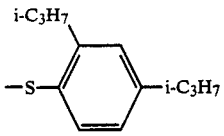

A3

-continued

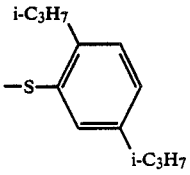

A4

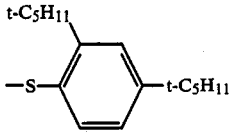

A5

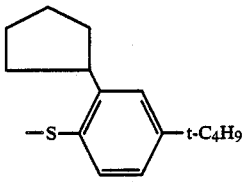

A6

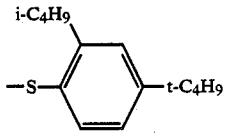

A7

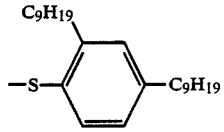

A8

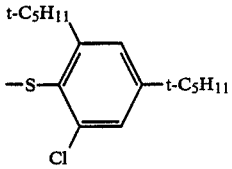

A9

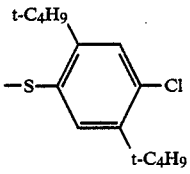

A10

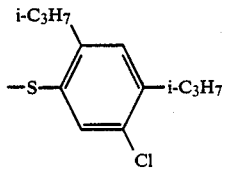

A11

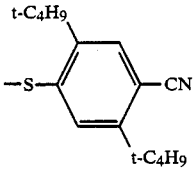

A12

Suitable groups B are, for example,

B1
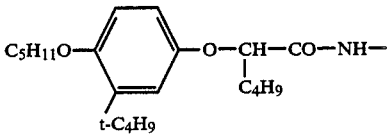
B2
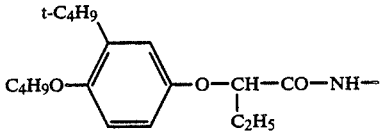
B3
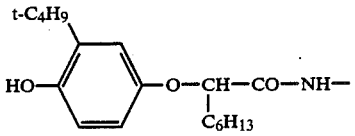
B4
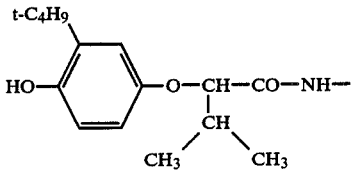
B5
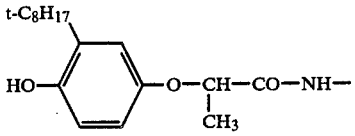
B6
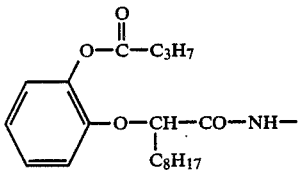
B7
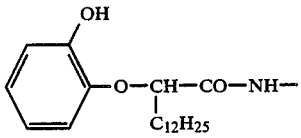
B8
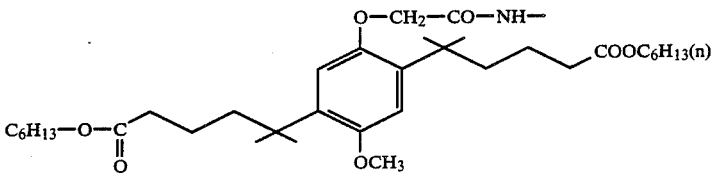
B9
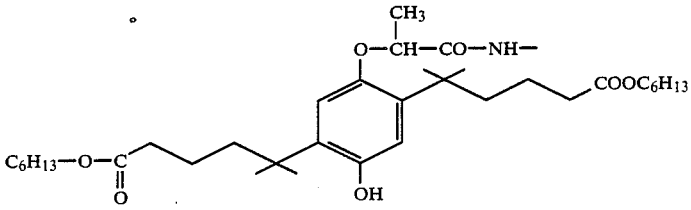
B10
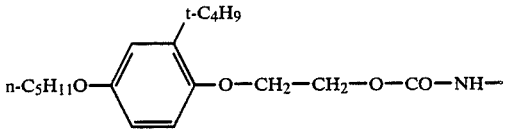

-continued
B11
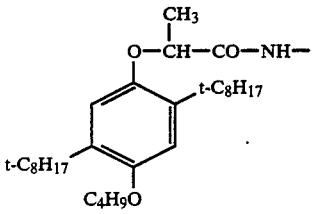
B12
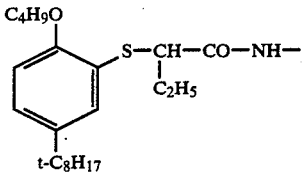
B13
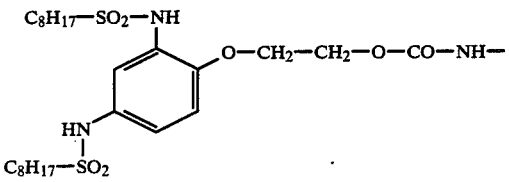
B14
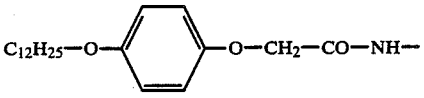
B15
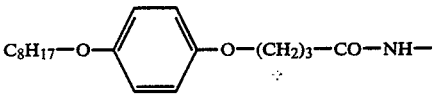
B16
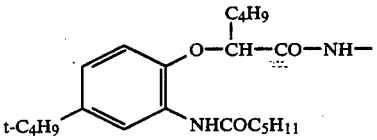
B17
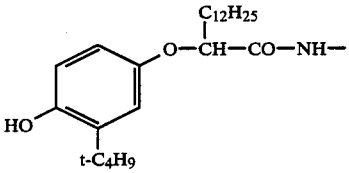
B18
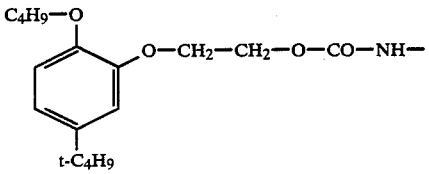
B19
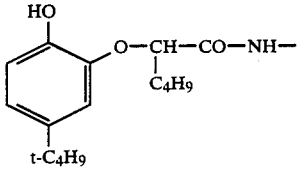
Suitable basic coupler molecules are, in particular the following:

C1
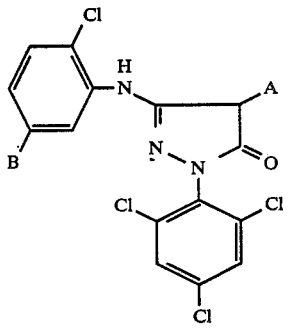
C2
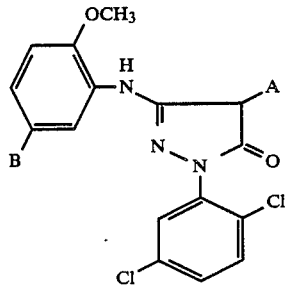
C3
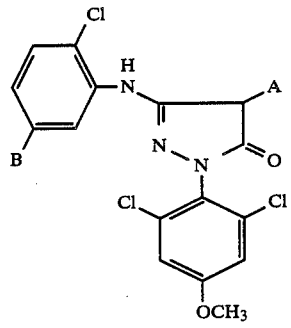
C4
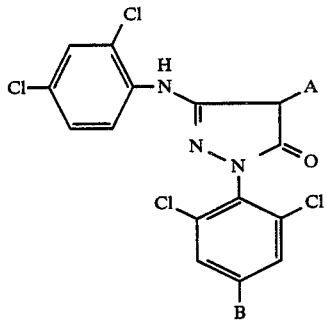
C5
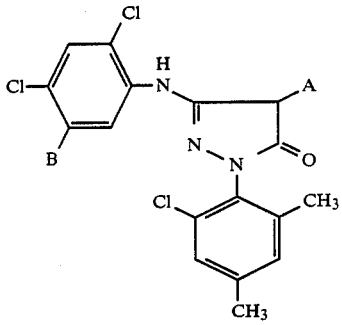

-continued

C6

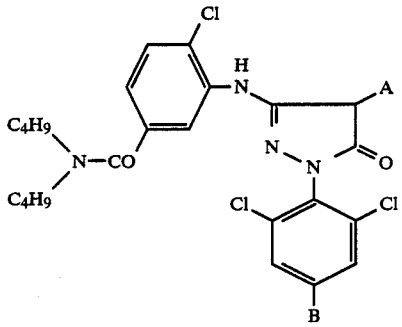

C7

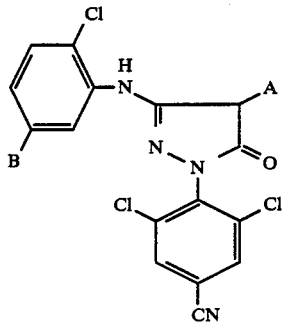

C8

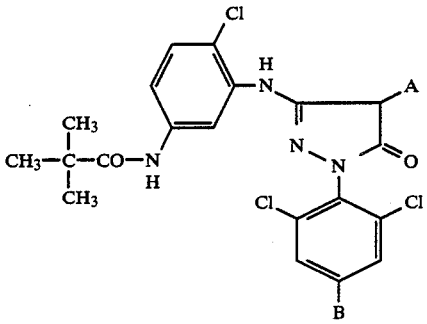

Particularly preferred couplers K are the compounds shown in Table 1 below.

| No. K | Basic coupler molecule C | Leaving group A | Stabilizing group B |
|---|---|---|---|
| 1 | C1 | A12 | B1 |
| 2 | C1 | A1 | B2 |
| 3 | C1 | A3 | B2 |
| 4 | C1 | A2 | B10 |
| 5 | C1 | A4 | B4 |
| 6 | C1 | A11 | B4 |
| 7 | C1 | A5 | B17 |
| 8 | C1 | A3 | B17 |
| 9 | C1 | A8 | B7 |
| 10 | C1 | A2 | B8 |
| 11 | C1 | A6 | B9 |
| 12 | C1 | A3 | B1 |
| 13 | C1 | A7 | B15 |
| 14 | C1 | A9 | B16 |
| 15 | C1 | A3 | B18 |
| 16 | C1 | A5 | B19 |
| 17 | C2 | A5 | B10 |
| 18 | C2 | A8 | B5 |
| 19 | C2 | A7 | B17 |
| 20 | C2 | A3 | B14 |
| 21 | C2 | A3 | B3 |
| 22 | C2 | A12 | B18 |
| 23 | C3 | A1 | B1 |
| 24 | C3 | A2 | B2 |
| 25 | C3 | A10 | B6 |
| 26 | C3 | A8 | B19 |

-continued

| No. K | Basic coupler molecule C | Leaving group A | Stabilizing group B |
|---|---|---|---|
| 27 | C3 | A3 | B3 |
| 28 | C4 | A4 | B1 |
| 29 | C4 | A8 | B3 |
| 30 | C4 | A3 | B12 |
| 31 | C4 | A2 | B17 |
| 32 | C4 | A11 | B19 |
| 33 | C4 | A6 | B2 |
| 34 | C4 | A3 | B11 |
| 35 | C5 | A3 | B3 |
| 36 | C5 | A3 | B6 |
| 37 | C5 | A3 | B12 |
| 38 | C6 | A4 | B2 |
| 39 | C6 | A5 | B4 |
| 40 | C6 | A11 | B13 |
| 41 | C7 | A2 | B1 |
| 42 | C7 | A5 | B3 |
| 43 | C7 | A8 | B4 |
| 44 | C7 | A7 | B7 |
| 45 | C7 | A3 | B17 |
| 46 | C7 | A10 | B19 |
| 47 | C8 | A1 | B1 |
| 48 | C8 | A2 | B2 |
| 49 | C8 | A5 | B4 |
| 50 | C8 | A3 | B17 |
| 51 | C8 | A8 | B19 |
| 52 | C8 | A6 | B18 |

The couplers according to the invention are prepared from the corresponding pyrazolone derivatives having a free 4-position (4-equivalent couplers) and a thiophenol derivative, which corresponds to the leaving group, using the following methods:

1. A thiophenol derivative or a corresponding disulfide is converted into a sulfenyl-halide by reaction with a halogenating agent (for example chlorine, bromine, sulfuryl chloride, N-bromosuccinimide, etc.) and then reacted with a 4-equivalent coupler in the presence of a catalyst. This method may also be carried out by addition of halogen (i.e. halogen in the form of a gas or a liquid) to a mixture of a thiophenol derivative and a 4-equivalent coupler (US-PS No. 3,227,554).
2. After protection of the amino group of a 4-equivalent coupler by acylation (for example introduction of an acetyl or an ethoxycarbonyl group), its active position is treated with a halogenating agent and the resulting compound is reacted with a thiophenol derivative in the presence of a basic catalyst or in the absence of a catalyst. The desired 2-equivalent coupler is obtained by removal of the protective group (JA-OS No. 91862/77).

The thiophenols used as leaving groups may be obtained very easily from the corresponding phenols by sulfochlorination and reduction or by reaction with disulfur dichloride and reduction.

Accordingly, the effect of these compounds is that the 2-equivalent couplers prepared therewith are distinguished not only by outstanding photographic properties, but also by their ready obtainability.

The production of the basic coupler molecules is known.

In the production of the photosensitive color photographic recording materials, the non-diffusing couplers according to the invention may be incorporated in known manner in the casting solution of the silver halide emulsion layers or other colloid layers. For example, the oil-soluble or hydrophobic couplers may be added to a hydrophilic colloid solution, preferably from a solution in a suitable coupler solvent (oil former), optionally in the presence of a wetting agent or dispersant. The hydrophilic casting solution may of course contain other standard additives besides the binder. The solution of the coupler does not have to be directly dispersed in the casting solution for the silver halide emulsion layer or other water-permeable layer. Instead, it may even be advantageously first dispersed in an aqueous non-photosensitive solution of a hydrophilic colloid and the mixture obtained—optionally after removal of the low-boiling organic solvent used—subsequently mixed with the casting solution for the photosensitive silve halide emulsion layer or other water-permeable layer before application.

Suitable photosensitive silver halide emulsions are emulsions of silver chloride, silver bromide or mixtures thereof, optionally with a small content of silver iodide of up to 10 mole % in one of the hydrophilic binders normally used. Gelatin is preferably used as binder for the photographic layers, although it may be completely or partly replaced by other natural or synthetic binders.

The emulsions may be chemically and spectrally sensitized in the usual way and the emulsion layers and other non-photosensitive layers may be hardened with known hardeners in the usual way.

Color photographic recording materials normally contain at least one silver halide emulsion layer for recording light of each of the three spectral regions, red, green and blue. To this end, the photosensitive layers are spectrally sensitized in known manner by suitable sensitizing dyes. Blue-sensitive silver halide emulsion layers do not necessarily have to contain a spectral sensitizer, because in many cases the natural sensitivity of the silver halide is sufficient for recording blue light.

Each of the photosensitive layers mentioned may consist of a single layer or, in known manner, for example as in the so-called double layer arrangement, may also comprise two or even more partial silver halide emulsion layers (DE-C-No. 1 121 470). Normally, red-sensitive silver halide emulsion layers are arranged nearer the layer support than green-sensitive silver halide emulsion layers which in turn are arranged nearer than blue-sensitive emulsion layers, a non-photosensitive yellow filter layer generally being arranged between the green-sensitive layers and blue-sensitive layers. However, other arrangements are also possible. A non-photosensitive intermediate layer, which may contain agents to prevent the unwanted diffusion of developer oxidation products, is generally arranged between layers of different spectral sensitivity. Where several silver halide emulsion layers of the same spectral sensitivity are present, they may be arranged immediately adjacent one another or in such a way that a photosensitive layer of different spectral sensitivity is present between them (DE-A-No. 1 958 709, DE-A-No. 2 530 645, DE-A-No. 2 622 922).

Color photographic recording materials for the production of multicolor images normally contain dye-producing compounds, more especially color couplers in the present case, for producing the different component dye images cyan, magenta and yellow in spatial and spectral association with the silver halide emulsion layers of different spectral sensitivity, the magenta component dye image being formed at least partly by the couplers according to the invention.

In the context of the invention, spatial association means that the color coupler is present in such a spatial relationship to the silver halide emulsion layer that the two are capable of interacting in such a way as to allow imagewise accordance between the silver image formed during development and the dye image produced from the color coupler. This result is generally achieved by the fact that the color coupler is contained in the silver halide emulsion layer itself or in an adjacent, optionally non-photosensitive binder layer.

By spectral association is meant that the spectral sensitivity of each of the photosensitive silver halide emulsion layers and the color of the component dye image produced from the particular spatially associated color coupler bear a certain relationship to one another, another color of the particular component dye image (for example cyan, magenta, yellow) being associated with each of the spectral sensitivities (red, cyan, blue).

One or more color couplers may be associated with each of the differently spectrally sensitized silver halide emulsion layers. Where several silver halide emulsion layers of the same spectral sensitivity are present, each of them may contain a color coupler, the color couplers in question not necessarily having to be the same. They are merely required to produce at least substantially the same color during color development, normally a color which is complementary to the color of the light to which the silver halide emulsion layers in question are predominantly sensitive.

In preferred embodiments, therefore, at least one non-diffusing color coupler for producing the cyan component dye image, generally a coupler of the phenol or α-naphthol type, is associated with red-sensitive silver halide emulsion layers. At least one non-diffusing color coupler for producing the magenta component dye image, normally color couplers of the 5-pyrazolone, indazolone or pyrazolotriazole type, is associated with green-sensitive silver halide emulsion layers. Finally, at least one non-diffusing color coupler for producing the yellow component dye image, generally a color coupler containing an open-chain ketomethylene group, is associated with blue-sensitive silver halide emulsion layers. Color couplers of this type are known in large numbers and are described in a number of patent specifications. Rereference is made here for example to the publications "Farbkuppler (Color Couplers)" by W. PELZ in Mitteilungen aus den Forschungslaboratorien der Agfa, Leverkusen/Munchen", Vol. III, page 111 (1961) and by K. VENKATARAMAN in "The Chemistry of Synthetic Dyes", Vol. 4, 341 to 387, Academic Press (1971). At least some of the magenta couplers are the couplers according to the invention.

The color couplers according to the invention may be both typical 4-equivalent couplers and also 2-equivalent couplers in which a smaller quantity of silver halide is required for dye production. 2-equivalent couplers are known to be derived from the 4-equivalent couplers in that they contain in the coupling position a substituent which is eliminated during the coupling reaction. 2-equivalent couplers include both those which are substantially colorless and also those which have a strong color of their own which either disappears during the color coupling reaction or is replaced by the color of the image dye produced. Couplers of the latter type may also be additionally present in the photosensitive silver halide emulsion layers where they serve as masking couplers for compensating the unwanted secondary densities of the image dyes. However, 2-equivalent couplers also include the known white couplers, although couplers such as these do not produce a dye on reaction with color developer oxidation products. 2-equivalent couplers also include the known DIR couplers, i.e. couplers which contain in the coupling position a releasable group which is released as a diffusing development inhibitor on reaction with color developer oxidation products. Other photographically active compounds, for example development accelerators or fogging agents, may also be released from such couplers during development.

In addition to the constituents mentioned above, the color photographic recording material according to the invention may contain further additives, for example antioxidants, dye stabilizers and agents for influencing mechanical and electrostatic properties. In order to reduce or avoid the unfavorable effect of UV light on the dye images produced with the color photographic recording material according to the invention, it is of advantage to use UV-absorbing compounds in one or more of the layers contained in the recording material, preferably in one of the upper layers. Suitable UV absorbers are described, for example, in US-A-No. 3 253 921, in DE-C-No. 2 036 719 and in EP-A-No. 0 0157 160.

For the production of color photographic images, the color photographic recording material according to the invention is developed with a color developer compound. Suitable color developer compounds are any developer compounds which are capable of reacting in the form of their oxidation product with color couplers to form azomethine dyes. Suitable color developer compounds are aromatic compounds containing at least one primary amino group of the p-phenylenediamine type, for example N,N-dialkyl-p-phenylenediamines, such as N,N-diethyl-p-phenylenediamine, 1-(N-ethyl-N-methylsulfonamidoethyl)-3-methyl-p-phenylenediamine, 1-(N-ethyl-N-hydroxyethyl)-3-methyl-p-phenylenediamine and 1-(N-ethyl-N-methoxyethyl)-3-methyl-p-phenylenediamine.

The usual layer supports may be used for the materials according to the invention, cf. Research Disclosure no. 17 643, Section XVII.

Suitable protective colloids or binders for the layers of the recording material are any of the usual hydrophilic film-forming agents, for example proteins, more especially gelatin. Casting aids and plasticizers may be used. Reference is made in this connection to the compounds cited in the above-mentioned Research Disclosure 16 743, Sections IX, XI and XII.

The layers of the photographic material may be hardened in the usual way, for example with hardeners of the epoxide, heterocyclic ethyleneimine and acryloyl type. The layers may also be hardened by the process according to DE-OS No. 2 218 009 to obtain color photographic materials which are suitable for high-temperature processing. The photographic layers may also be hardened with hardeners of the diazine, triazine or 1,2-dihydroquinoline series or with hardeners of the vinylsulfone type. Other suitable hardeners are known from DE-OS No. 2 439 551, DE-OS No. 2 225 230 and 2 317 672 and from the above-mentioned Research Disclosure 17 643, Section XI.

Other suitable additives are mentioned in Research Disclosure 17 643 and in Product Licensing Index, December 1971, pages 107 to 110.

Other suitable color developers are described, for example, in J. Amer. Chem. Soc. 73, 3100 (1951) and in G. Haist, Modern Photographic Processing, 1979, John Wiley and Sons, New York, pages 545 et seq.

After color development, the material is bleached and fixed in the usual way. Bleaching and fixing may be carried out separately from or even together with one another. Suitable bleaches are any of the usual compounds, for example $Fe^{3+}$ salts and $Fe^{3+}$ complex salts, such as ferricyanides, dichromates, water-soluble cobalt complexes, etc. Particularly preferred bleaches are iron (III) complexes of aminopolycarboxylic acids, more especially for example ethylenediamine tetra-acetic acid, N-hydroxyethyl ethylenediamine triacetic acid, alkyliminodicarboxylic acids, and of corresponding phosphonic acids. Persulfates are also suitable bleaches.

EXAMPLE 1

Color photographic recording materials were prepared as follows:

(a) Preparation of the color coupler emulsates 8 mmoles color coupler are dissolved at 50° to 70° C. in the same quantity by weight of dibutylphthalate and in three times the quantity by weight of ethyl acetate in the presence of 0.15 g of sulfosuccinic acid dioctyl ester. The solution is then stirred into 150 g of a 7.5% by weight aqueous gelatin solution heated to approximately 40° C.

(b) Preparation of the color photographic recording materials to be tested

The emulsate prepared as described in (a) is mixed with a silver halide emulsion containing 8.2 g of silver in the form of silver bromide, 9.2 g of gelatin and 0.04 g of sodium dodecyl benzenesulfonate. The total volume is made up with water to 350 ml. The casting solution thus prepared is cast onto a layer support of cellulose triacetate (0.8 g Ag/$m^2$).

(c) Processing and evaluation

After drying, the material is exposed behind a wedge and color-developed:

1. Developer bath—3.25 mins.

8000 g water, dist.
47 g (N-ethyl-N-β-hydroxyethylamino)-2-methylaniline sulfate
25 g hydroxylammonium sulfate
39 g sodium sulfite
15.5 g sodium hydrogen carbonate
335 g potassium carbonate
13.5 g potassium bromide
make up with dist. water to 10 1; pH 10.

2. Bleach fixing bath—1.5 mins.

35 ml ammonia solution (28% by weight)
30 g ethylenediamine tetra-acetic acid (EDTA)
15 g $Na_2SO_3$
100 g ammonium thiosulfate
60 g sodium (EDTA) iron (III) complex
make up with water to 1000 ml; pH 7.

3. Rinsing—3 mins.

Table 1 shows the color couplers used and the fresh sensitometry observed therewith.

In addition, the last two columns of the Table show the measured densities in % in the blue and red spectral region for maximal density of the samples.

Comparison couplers

M1

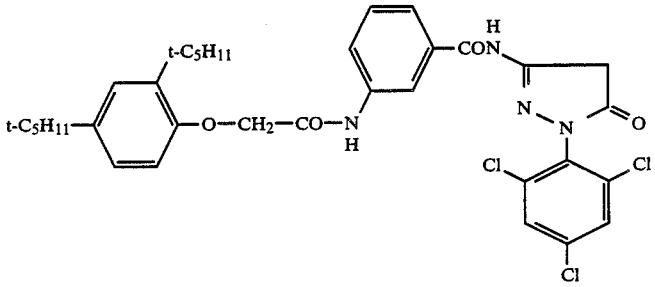

M2

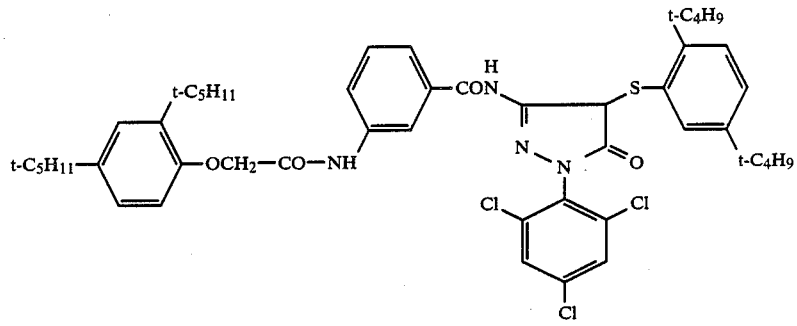

M3

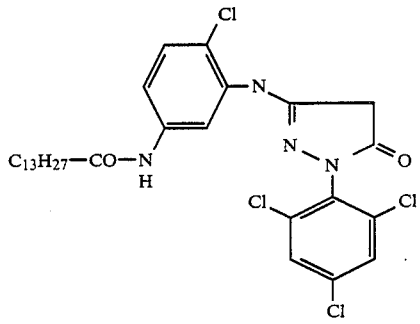

-continued

Comparison couplers

M4

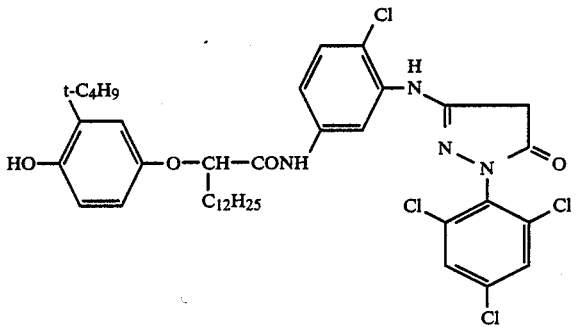

M5

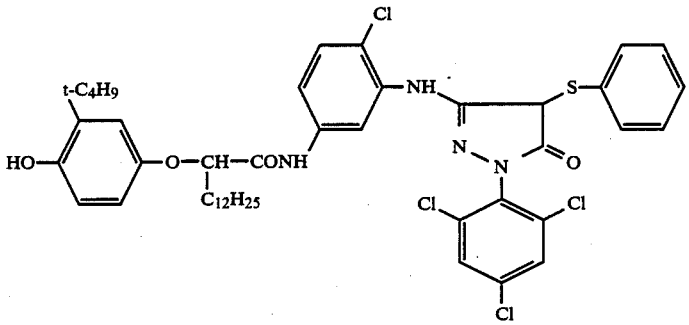

TABLE 1

| | Coupler | Sensitivity [DIN] | Color yield | Gamma | % Secondary density at $D_{max}$ Blue | Red |
|---|---|---|---|---|---|---|
| A | M1 | 19.8 | 1.72 | 0.85 | 13 | 10 |
| B | M2 | 17.2 | 1.18 | 0.53 | 14 | 9 |
| C | M3 | 21.0 | 2.04 | 0.98 | 9 | 7 |
| D | M4 | 20.6 | 1.96 | 0.93 | 10 | 10 |
| E | M5 | 23.1 | 2.78 | 2.16 | 29 | 27 |
| F | K4 | 23.2 | 3.04 | 2.12 | 9 | 8 |
| G | K8 | 23.5 | 2.96 | 2.34 | 9 | 10 |
| H | K12 | 23.1 | 3.01 | 2.10 | 8 | 7 |
| J | K24 | 22.9 | 3.12 | 1.98 | 9 | 8 |
| K | K31 | 23.2 | 2.82 | 2.05 | 10 | 11 |
| L | K41 | 23.6 | 3.14 | 2.12 | 8 | 8 |

Table 1 shows that the couplers according to the invention show a marked dye production tendency, i.e. they couple with high sensitivity and steep gradation and form brilliant dyes in excellent yields. The residual coupler or rather the group eliminated during the coupling reaction does not block bleaching of the silver, as observed in the case of sample E.

Formalin test:

In this test, samples A to L are exposed for 7 days to an atmosphere containing 4 ppm of formalin at room temperature/70% rel. humidity. For comparison, the same samples were stored under the same conditions, but without formalin. After storage, the samples were developed as follows:

| Development cycle Bath | (Temperature 38° C.) Mins. |
|---|---|
| Color development | 3.25 |
| Bleaching | 6.5 |
| Rinsing | 3 |
| Fixing | 6.5 |
| Rinsing | 6 |

1. Developer (1 l batch)
800 ml water, dist.
4.5 g 4-(N-ethyl-N-β-hydroxyethylamino)-2-methylanilin sulfate
2.5 g hydroxylammonium sulfate
4.0 g sodium sulfite
1.5 g sodium hydrogen carbonate
33.5 g potassium carbonate
1.35 g potassium bromide
make up with dist. water to 1 l; pH 10.0.

2. Bleaching bath (1 l batch)
800 ml water
139 g ammonium bromide
86 g ammonium (EDTA) iron(III) complex
16 g ethylenediamine tetra-acetic acid
10 g ammonia
make up with water to 1 l and adjust to pH 6.0 with approx. 15 ml glacial acetic acid.

3. Fixing bath (1 l batch)
800 ml water
150 g ammonium thiosulfate
10 g sodium sulfite
2 g sodium hexametaphosphate
make up with water to 1 ; l pH approx. 7.5.

Table 2 shows the percentage reductions in density at maximal density

TABLE 2

| | |
|---|---|
| A | −56% |
| B | −4% |
| C | −67% |
| d | −62% |
| E | −2% |
| F | −3% |
| G | −4% |
| H | −0% |
| J | +3% |
| K | −3% |
| L | +2% |

The Table shows that the couplers according to the invention are distinguished by high formalin stability.

EXAMPLE 2

Casting solutions were prepared in the same way as described in Example 1. These casting solutions were applied as a layer to a paper support of which the surfaces had been lined with polyethylene. The samples M–T thus obtained were hardened and developed as follows:

| Development cycle | Bath | Mins. |
|---|---|---|
| (Temperature 33° C.) | Color developer | 3.5 |
| | Stop bath | 1 |
| | Water | 2 |
| | Bleach fixing bath | 2 |
| | Water | 4 |

1. Color developer
800 ml water
12 ml diethylene glycol

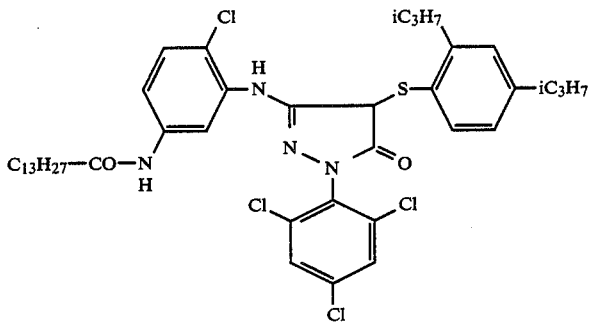

M6

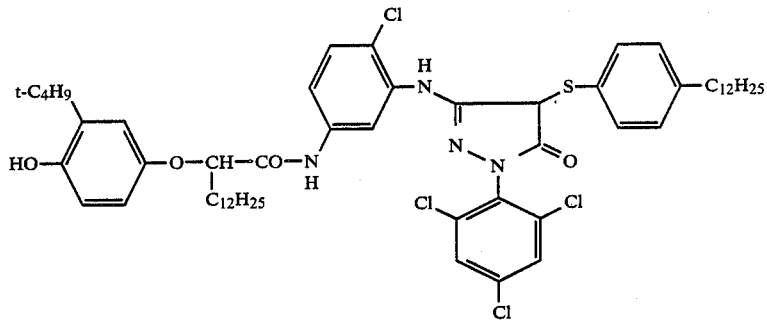

M7

15 ml benzylalcohol
3 g hydroxylammonium sulfate
1 g diethylenetriamine penta-acetic acid
2 g potassium disulfite
1 g sodium hydroxide
1 g potassium bromide
5 g 3-methyl-4-amino-N-ethyl-N-(β-methanesulfonamidoethyl)-aniline sulfate
34 g potassium carbonate
make up with water to 1 ; l pH 10.25

2. Stop bath
800 ml water
40 g sodium acetate
25 g glacial acetic acid
make up with water to 1 liter.

3. Bleach fixing bath
800 ml water
45 g $NH_4$-Fe-EDTA
2 g Trilon BS
5 g ammonium thiosulfate
11 g sodium disulfite
make up with water to 1 liter and adjust to pH 6.7 with ammonia or acetic acid.

TABLE 3

| | Coupler | Residual Ag image | X | $X_{yw}$ | $D_{yw}$ |
|---|---|---|---|---|---|
| M | M5 | + | 38 | 0.09 | 19 |
| N | M6 | – | 56 | 0.04 | 12 |
| O | M7 | – | 44 | 0.07 | 18 |
| P | K4 | – | 25 | 0.03 | 12 |
| Q | K8 | – | 24 | 0.04 | 11 |
| R | K12 | – | 22 | 0.03 | 12 |
| S | K27 | – | 18 | 0.01 | 10 |
| T | K46 | – | 26 | 0.04 | 13 |

X = light stability: irradiation with $7.2 \times 10^6$ lux · h (samples behind UV film) density loss in % for starting density D = 1.0
$X_{yw}$ = light stability of the white areas of the image (for conditions, see above) increase in yw-fog (yellowing of residual coupler under the effect of light)
$D_{yw}$ yellowing after 14 days at 90° C./40% relative humidity Comparison couplers Table 3 shows that the couplers according to the invention avoid a residual silver image, produce good light stability and show minimal yellowing both under the effect of light and during storage in darkness.

EXAMPLE 3

Samples A to L were developed
(a) as described in Example 2,
(b) as described in Example 2, but using a color developer without diethylene glycol and benzyl alcohol for otherwise the same formulation.

The enhancement factor arising out of the addition of the two organic solvents was determined as follows:

$$V_{LM} = \left[ \frac{E_a}{F_b} + \frac{CY_a}{CY_b} \right] \cdot 10$$

$E_a$=sensitivity in DIN in process a
$E_b$=sensitivity in DIN in process b
$CY_a$=color yield in process a
$CY_b$=color yield in process b

TABLE 4

| | $\frac{E_a}{E_b}$ | $\frac{CY_a}{CY_b}$ | $V_{LM}$ |
|---|---|---|---|
| A | 1.12 | 1.05 | 21.7 |
| B | 1.25 | 1.15 | 24.0 |
| C | 1.06 | 1.18 | 22.4 |
| D | 1.04 | 1.12 | 21.6 |
| E | 1.02 | 1.10 | 21.2 |
| F | 1.04 | 1.03 | 20.7 |
| G | 1.03 | 1.03 | 20.6 |
| H | 1.05 | 1.01 | 20.6 |
| J | 1.06 | 1.03 | 20.9 |
| K | 1.03 | 1.02 | 20.5 |
| L | 1.04 | 1.05 | 20.9 |

Table 4 shows that the couplers according to the invention are significantly less affected in their dye production activity than state-of the-art couplers. This means that the result of development with and without benzylalcohol/diethylene glycol is the same within the usual variations so that these solvents may be left out without any disadvantage.

EXAMPLE 4

A layer support lined on both sides with polyethylene was coated with the following layers. All the quantities indicated are based on 1 $m^2$.

1. A substrate layer of 200 mg of gelatin containing additions of $KNO_3$ and chrome alum.
2. A blue-sensitive silver bromide chloride emulsion layer (5 mole % chloride) of 600 mg of $AgNO_3$ containing 2100 mg of gelatin, 1.1 mmoles yellow coupler Y, 27.7 mg of 2,5-dioctylhydroquinone and 1200 mg of tricresylphosphate.
3. An intermediate layer of 1300 mg of gelatin, 80 mg of 2,5-dioctylhydroquinone and 100 mg of tricresylphosphate.
4. A green-sensitive silver bromide chloride emulsion layer (20 mole % chloride) of 330 mg of $AgNO_3$ containing 750 mg of gelatin, 0.500 mmole of magenta coupler, 118 mg of α-(3-t-butyl-4-hydroxyphenoxy-myrystic acid ethyl ester, 43 mg of 2,5-dichloro-octylhydroquinone, 343 mg of dibutylphthalate and 43 mg of tricresylphosphate.
5. An intermediate layer of 1550 mg of gelatin, 285 mg of the following UV absorber

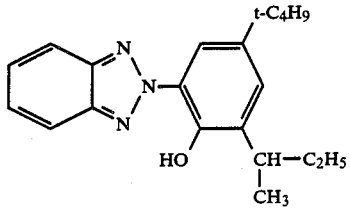

1 80 mg of dioctylhydroquinone and 650 mg of tricresylphosphate.

6. A red-sensitive silver bromide chloride emulsion layer (20 mole % chloride) of 400 mg of $AgNO_3$ containing 1470 mg of gelatin, 0.780 mmoles of cyan coupler C, 285 mg of dibutylphthalate and 122 mg of tricresylphosphate.
7. A protective layer of 1200 mg of gelatin and 134 mg of the same UV absorber as in layer 5.
8. A hardening layer of 400 mg of gelatin and 400 mg of the following hardener

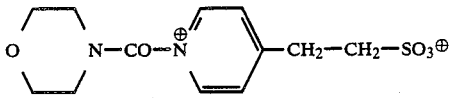

Various color photographic materials were prepared with the magenta couplers shown in the following Table.

After exposure and processing as described in Example 2, these samples were subjected to a fading test in which they were exposed to a total quantity of light of $9.6 \times 10^6$ lux.h.

Table 5 shows the light stability of the dyes produced from the various magenta couplers and, in the last column, the excellent color yields which were also obtained in the multilayer material containing the couplers according to the invention.

TABLE 5

| | | Xenon test | |
|---|---|---|---|
| Material | Magenta coupler | Magenta density originally D = 1.0 | Color Yield |
| 1 | M3 | 0.74 | 1.92 |
| 2 | M4 | 0.81 | 1.76 |
| 3 | M5 | 0.72 | 2.64 |
| 4 | M6 | 0.68 | 2.82 |
| 5 | K4 | 0.86 | 2.86 |
| 6 | K8 | 0.87 | 2.95 |
| 7 | K12 | 0.82 | 2.78 |
| 8 | K41 | 0.81 | 2.65 |

Table 5 shows that the compounds according to the invention also show their favorable properties in multi layer materials. These are, in particular, improved light stability for a high dye production tendency.

Yellow coupler Y

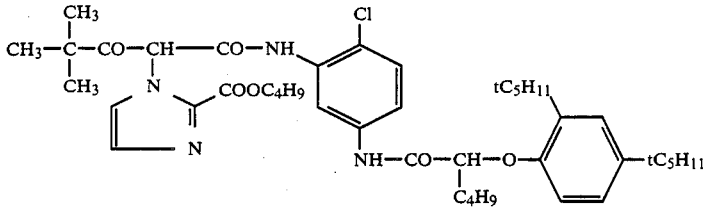

-continued

Cyan coupler C

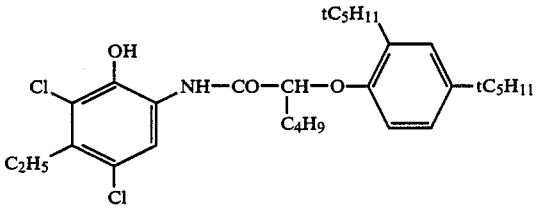

I claim:

1. A color photographic recording material comprising at least one silver halide emulsion layer and at least one layer containing a 2-equivalent magenta coupler corresponding to the following formula

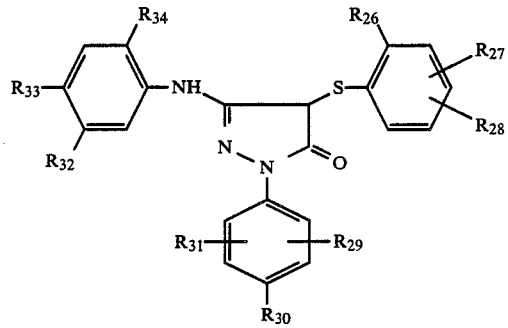

in which $R_{26}$ is $C_3$–$C_{12}$ alkyl, $R_{27}$ is $C_3$–$C_9$ alkyl, more especially secondary or tertiary $C_3$–$C_9$ alkyl or chlorine, the total number of carbon atoms in the alkyl radicals $R_{26}$ and $R_{27}$ being from to 16, $R_{28}$ is hydrogen, chlorine or cyano, $R_{29}$ is chlorine, $R_{30}$ is hydrogen, methoxy, chlorine, methyl, cyano or $B_1$, $R_{31}$ is chlorine or methyl, $R_{32}$ is hydrogen, di-$C_1$–$C_6$-alkylaminocarbonyl, $C_1$–$C_6$-alkylcarbonylamino or $B_1$, $R_{33}$ is hydrogen or chlorine and $R_{34}$ is chlorine or methoxy, either $R_{30}$ or $R_{32}$ having the meaning $B_1$, and $B_1$ is a group of the formula

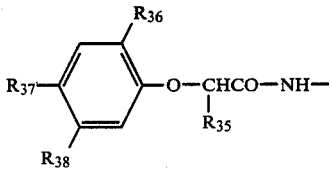

in which $R_{35}$ is hydrogen or $C_1$–$C_{12}$ alkyl, $R_{36}$ is hydrogen, $C_1$–$C_8$ alkoxy, hydroxy, $C_1$–$C_8$ alkylcarbonyloxy or $C_1$–$C_8$ alkyl, $R_{37}$ is hydrogen, hydroxy, or $C_1$–$C_{12}$ alkoxy and $R_{38}$ is hydrogen or $C_1$–$C_8$ alkyl.

2. A color photographic material as claimed in claim 1, in which $R_{26}$ and $R_{27}$ are alkyl radicals together containing from 6 to 16 carbon atoms, $R_{28}$ and $R_{33}$ are hydrogen, $R_{29}$, $R_{30}$, $R_{31}$ and $R_{34}$ are chlorine and $R_{32}$ is a group corresponding to the following formula

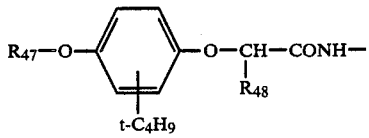

in which $R_{47}$ and $R_{48}$ are hydrogen or $C_1$–$C_{12}$ alkyl.

3. A color photographic material comprising at least one silver halide emulsion layer and at least one layer containing a 2-equivalent magenta coupler corresponding to the following formula

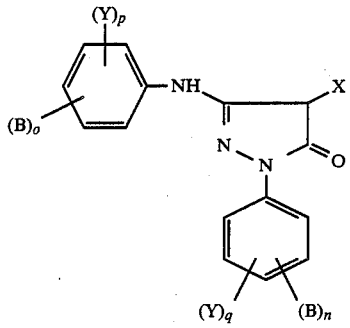

in which

B is a stabilizing group, selected from the group consisting of groups of mono- and polyols and ethers thereof, sulfamidophenols, secondary or tertiary aromatic amino compounds, and thiophenol derivatives, said stabilizing group being attached through bridge members, Y is halogen, alkoxy, alkyl, alkylsulfonyl, acylamino, alkoxycarbonyl, aminocarbonyl, amino, trifluoromethyl or cyano, X is a group corresponding to the following formula

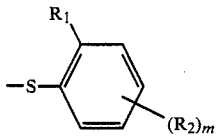

$R_1$ is alkyl containing at least 3 carbon atoms, $R_2$ is alkyl, halogen, cyano or trifluoromethyl, m, is 0, 1 or 2, n, o are each 0 or 1 provided that n is 1 when o is 0 and n is 0 or 1 when o is 1;

p is 0, 1, 2 or 3 provided that $p+o \leqq 3$, q is 0 or an integer of up to 5 provided that $q+n \leqq 5$, with the proviso that, where m, p, and/or q have a value of $>1$, the substituents $R^2$, and Y maybe the same or different.

4. A color photographic recording material as claimed in claim 3 in which the sum of the carbon atoms in the alkyl radicals $R_1$ and $R_2$ is $\geqq 6$.

* * * * *